US007777418B2

(12) United States Patent
Ramaiah

(10) Patent No.: US 7,777,418 B2
(45) Date of Patent: Aug. 17, 2010

(54) CERAMIC METAL HALIDE LAMP INCORPORATING A METALLIC HALIDE GETTER

(75) Inventor: Raghu Ramaiah, Euclid, OH (US)

(73) Assignee: General Electric Company, Schenectady, NY (US)

( * ) Notice: Subject to any disclaimer, the term of this patent is extended or adjusted under 35 U.S.C. 154(b) by 386 days.

(21) Appl. No.: 12/099,212

(22) Filed: Apr. 8, 2008

(65) Prior Publication Data

US 2009/0251053 A1 Oct. 8, 2009

(51) Int. Cl.
*H01J 17/24* (2006.01)
*H01J 61/26* (2006.01)

(52) U.S. Cl. ..... 313/553; 313/563; 252/181.1; 252/181.6

(58) Field of Classification Search ..... 313/545–566; 252/181.1–181.7
See application file for complete search history.

(56) References Cited

U.S. PATENT DOCUMENTS 4,360,756 A * 11/1982 Spencer et al. ..... 313/553
4,810,938 A 3/1989 Johnson et al.
4,910,432 A 3/1990 Brown et al.
5,270,615 A 12/1993 Chang
5,343,118 A 8/1994 Chang
5,438,244 A 8/1995 Chang
5,461,281 A * 10/1995 Fromm et al. ..... 313/553
5,879,215 A 3/1999 Duffy et al.
5,973,453 A 10/1999 Van Vliet et al.
6,031,331 A 2/2000 Kohlmann et al.
6,054,810 A 4/2000 Yamamoto et al.
6,069,456 A 5/2000 Fromm et al.
6,172,462 B1 1/2001 Gibson et al.
6,586,878 B1 7/2003 Tu
7,057,350 B2 6/2006 Lambrechts et al.

FOREIGN PATENT DOCUMENTS

EP 0 286 247 A1 12/1988
EP 0 286 247 B1 12/1988
EP 0 869 540 10/1998
JP 11025924 A * 1/1999
WO WO 99/41761 8/1999

* cited by examiner

*Primary Examiner*—Mariceli Santiago
(74) *Attorney, Agent, or Firm*—Fay Sharpe LLP

(57) ABSTRACT

An electroded high watt ceramic metal halide lamp assembly is provided which comprises a light transmissive arc-tube surrounding at least one electrode, a fill disposed in the arc-tube that includes at least one metal halide component and at least one metallic halide getter. The metallic halide getter has a Gibbs Free Energy greater than mercury halide and less than thallium halide, vapor pressure less than mercury halide, free energy of formation of oxide less than Aluminum oxide.

21 Claims, 3 Drawing Sheets

CERAMIC METAL HALIDE LAMP INCORPORATING A METALLIC HALIDE GETTER

BACKGROUND OF THE INVENTION

The present invention relates to an electroded ceramic metal halide lamp (CMH) assembly, and more particularly, to the lumen maintenance of a CMH.

CMH lamps can have severe degradation in 100 hr lumens. Such degradation has been known to occur quickly, for example, reduction of 100 hr lumens by 25% in the first 1000 hours of lamp operation. Degradation is believed to arise from wall blackening of the arc-tube.

Lumen degradation is primarily due to the transport of tungsten to the walls of the discharge tube, by sputtering during starting, and by chemical transport as halides of tungsten in steady state operation. While halides are necessary components of the arc discharge fill, the transport of tungsten during steady state operation is greatly enhanced by the formation of excess halides, such as iodine. Excess iodine found in most high-intensity discharge (HID) lamps is bound by mercury, which forms a mercury iodide.

In order to optimize lumen maintenance, a design choice is sometimes made that shifts the lamp into a design space that sub-optimizes other key critical-to-quality (CTQ) factors such as color rendering index (CRI), correlated color temperature (CCT), color control, etc. However, it would be desirable to reduce the impact of lumen degradation without sacrificing other CTQ factors.

BRIEF DESCRIPTION OF THE INVENTION

In accord with a first embodiment of the present invention, an electroded ceramic metal halide lamp is provided including metallic halide getters to allow optimization of lumen maintenance without sacrificing a region of the arc-tube design space that allows optimization of other key CTQ factors. The metallic halides formed from the getters have a Gibbs free energy lower than mercury iodide, but higher than dysprosium iodide, holmium iodide, thulium iodide, sodium iodide and thallium iodide.

Preferably, metallic halides formed from the getters of the present invention have a vapor pressure lower than mercury iodide.

In addition, the metallic halides formed from getters create a metallic oxide getter that is less stable than aluminum oxide. The use of metallic halide getters reduce lumen degradation. In another aspect of the present invention, an electroded ceramic metal halide lamp assembly is provided which comprises a light transmissive arc-tube surrounding at least one electrode, a fill disposed in the arc-tube that includes at least one metal halide component; and at least one metallic halide getter wherein the metallic halide getter has a Gibbs free energy value of between about higher than mercury iodide and lower than thallium iodide.

In another aspect, an electroded ceramic metal halide lamp assembly is provided which comprises a light transmissive arc-tube surrounding at least one electrode. A fill disposed in the arc-tube includes at least one metal halide component and at least one metallic halide getter, wherein the metallic halide getter has a vapor pressure less than the vapor pressure of mercury iodide.

In yet another aspect of the present invention, an electroded ceramic metal halide lamp assembly is provided which comprises a light transmissive arc-tube surrounding at least one electrode, a fill disposed in the arc-tube that includes at least one metal halide component; and at least one metallic halide getter, wherein the metallic halide getter has a free energy of oxide formation less than the free energy of formation of aluminum oxide.

BRIEF DESCRIPTION OF THE DRAWINGS

The invention may take form in various components and arrangement of components, and in various steps and arrangement of steps. The drawings are only for purposes of illustrating a specific embodiment are not to be construed as limiting the invention.

DETAILED DESCRIPTION OF THE INVENTION

Lumen degradation is primarily due to the transport of tungsten to the walls of the arc discharge tube, by sputtering during starting, and by chemical transport as halides of tungsten during steady state operation. Halides contemplated by the present invention include bromide, chloride, iodide and other such halides. The transport of tungsten during steady state operation is greatly enhanced by the formation of excess iodine. For example, excess iodine is found in high intensity discharge (HID) lamps bound by mercury, forming mercury iodide, as opposed to the iodine bound to rare earth and sodium. By the addition of metallic halide components, or getters, to the arc discharge tube, the excess iodine is largely removed from the system, minimizing the formation of mercury iodide, and thereby minimizing tungsten transport in steady state operation.

Figure 1:
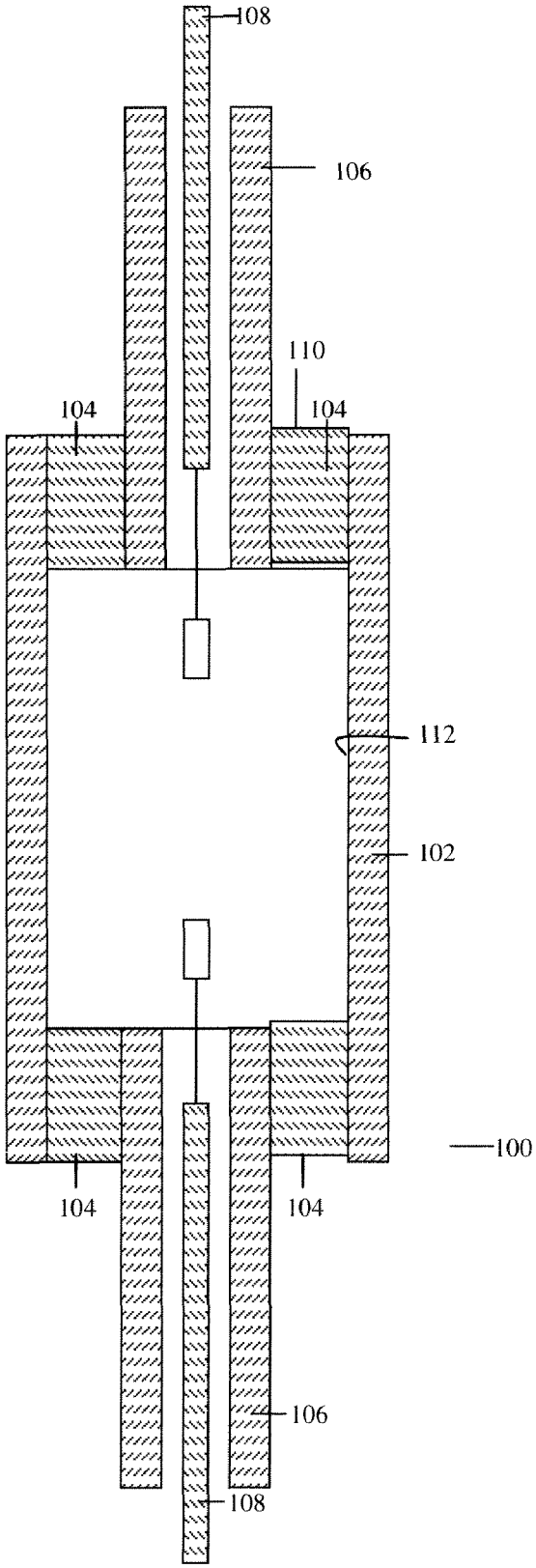
FIG. 1 is a schematic diagram of a ceramic metal halide lamp assembly according to the present invention.

FIG. 1 shows an electroded ceramic metal halide lamp assembly 100 according to the present invention. The walls of the arc discharge tube 102 can consist of a silica glass, as is known in the art. Preferentially, the discharge vessel walls are comprised of a ceramic, transparent or translucent material which can withstand high thermal conditions. For example, the discharge walls of the arc-tube can consist substantially of a monocrystalline metal oxide, such as sapphire, a polycrystalline sintered metal oxide, such as a polycrystalline sintered metal oxide (PCA), yttrium aluminum garnet or yttrium oxide, or of a polycrystalline non-oxidative material, such as aluminum nitride. Such materials allow for wall temperatures of 1500-1600K and resist chemical attacks by halides and sodium. The arc-tube is preferably tubularly shaped having annularly shaped end surfaces and cylindrically shaped outer and inner surfaces. The wall thickness can be of any suitable size.

The end caps 104 are formed from a suitable polycrystalline ceramic material, preferably polycrystalline alumina, which is in an unsintered or "green state". The end caps 104 must preferably include about 0.02 to about 0.2 percent by weight magnesium oxide with polycrystalline alumina powder. Each end cap 104 has a disc-shaped main wall 110, a cylindrically shaped skirt or flange, and a tubularly shaped extension or flange 106. The main wall 110 has a planar inner surface facing the end surface of the arc-tube and a planar outer surface facing away from the end surface of the arc-tube.

The "green" end caps 104 are initially heated to a prefiring or presintering temperature to remove organic or binder material and to develop green strength. The prefiring temperature is relatively low compared to the sintering temperature. Preferably, the prefiring temperature is in the range of about 900° C. to about 1100° C. The prefiring is preferably preformed in air but alternatively can be any other suitable oxidizing atmosphere for burning-off the organic material.

Once cooled, the presintered end caps 104 are placed over the ends of the arc-tube 102 with the end surfaces of the arc-tube engaging the inner surfaces of the end cap main walls and the outer surface of the arc-tube engaging the inner surfaces of the end cap flanges. The end caps, therefore, close the open ends of the arc-tube.

The end caps 104 are preferably formed by cold die pressing a mixture of fine ceramic powder into a desired shape. The end caps 104, however, can alternatively be formed by compressing ceramic powder into a body or block and machining the desired shape from the block, by injection molding, or by any other suitable process.

The flange 106 extends axially inward toward the arc-tube from the outer periphery of the main wall 110. The flange 106 has a cylindrically shaped inner surface which has a diameter sized to form a sufficient monolithic seal with the outer surface of the arc-tube 102. The length of the flange inner surface is sized to provide a sufficient sealing area between the end cap 104 and the arc-tube 102.

The flanges 106 extend axially outward from the outer surface of the main wall 110 and is located generally at the center of the main wall 110. The flange 106 and the main wall 110 cooperate to form an axially extending aperture or hole which passes entirely though the end cap 104. The aperture is sized and shaped to form a sufficient hermetic seal between the electrode assembly 108 and the end cap 104. Preferably, the aperture is cylindrically shaped. The length of the extension is sized to provide sufficient support for the electrode assembly 108 and to provide a sufficient sealing area between the end cap 104 and electrode assembly 108.

The electrode assembly 108 is of standard construction having a generally straight support and a coil secured to the inner end of the support. The support and the coil are each formed from a high temperature and electrically conductive metal such as molybdenum or tungsten.

The arc-tube 102 contains a metal halide fill which provides suitable efficacy and color rendition. As an example, a fill in the present invention comprises a combination of a sodium halide and a cerium halide along with xenon gas. Useful sodium and cerium halides can be selected from the group consisting of bromides, chlorides and iodides, including mixtures thereof such as sodium iodide and cerium chloride. The weight proportion of cerium halide is maintained no greater than the weight proportion of sodium halide in the fill, with a reservoir of these fill materials in the arc-tube being desirable to compensate for any loss of the individual constituents during lamp operation. A typical fill may also include an inert ignition gas, for example argon, and mercury, as well as other metal halide additives.

Figure 2:
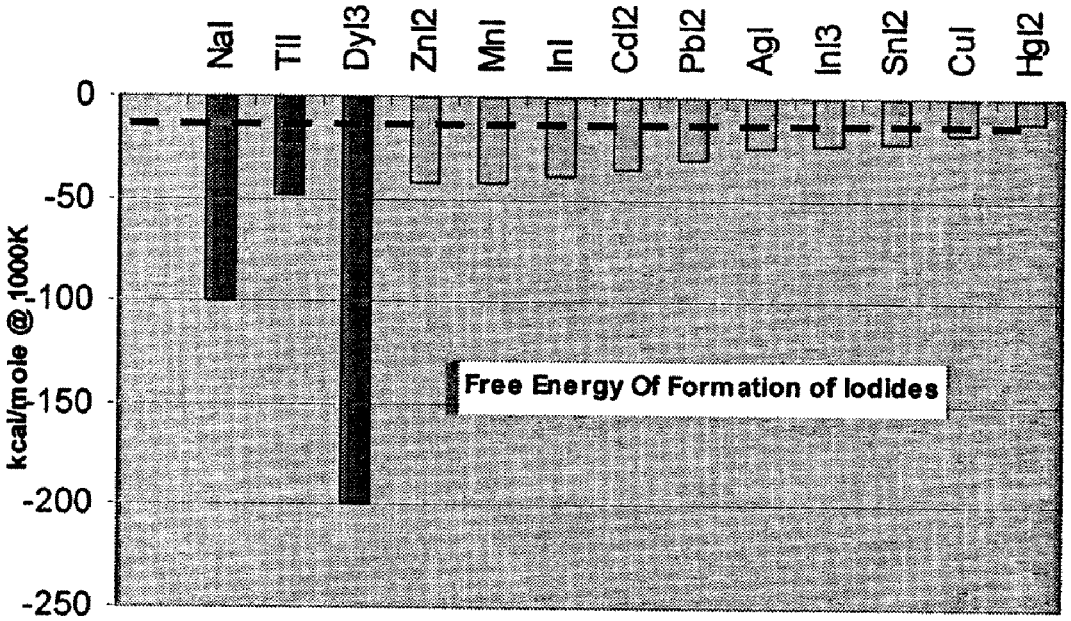
FIG. 2 graphically compares the Gibbs free energies of various potential getter iodides, including iodides dosed in ceramic metal halide lamps, at a temperature of 1000K.

In choosing a metallic halide getter in accord with the present invention, an important aspect is to choose a getter that has a free energy of formation less than the free energy of formation of the mercury halide. Lumen maintenance is optimized by reducing the amount of mercury iodide located within the arc-tube. Thus, the role of the getter is to remove the halide, most typically iodine, from the arc-tube before the free energy of formation of mercury iodide is reached. As can be seen in FIG. 2, iodides of zinc, manganese, indium, cadmium, lead and silver satisfy the criteria of metallic halide getters of the present invention having a free energy of formation less than mercury iodide.

The getter material can be incorporated into the lamp in the same manner as traditional getter materials are. These include, for example, as a strip of metal on a mounting tab associated with the electrode mechanism or attached to a frame secured to the ends of the arc tube. U.S. Pat. Nos. 7,057,350 and 6,586,878 provide teachings of this and are herein incorporated by reference.

Figure 3:
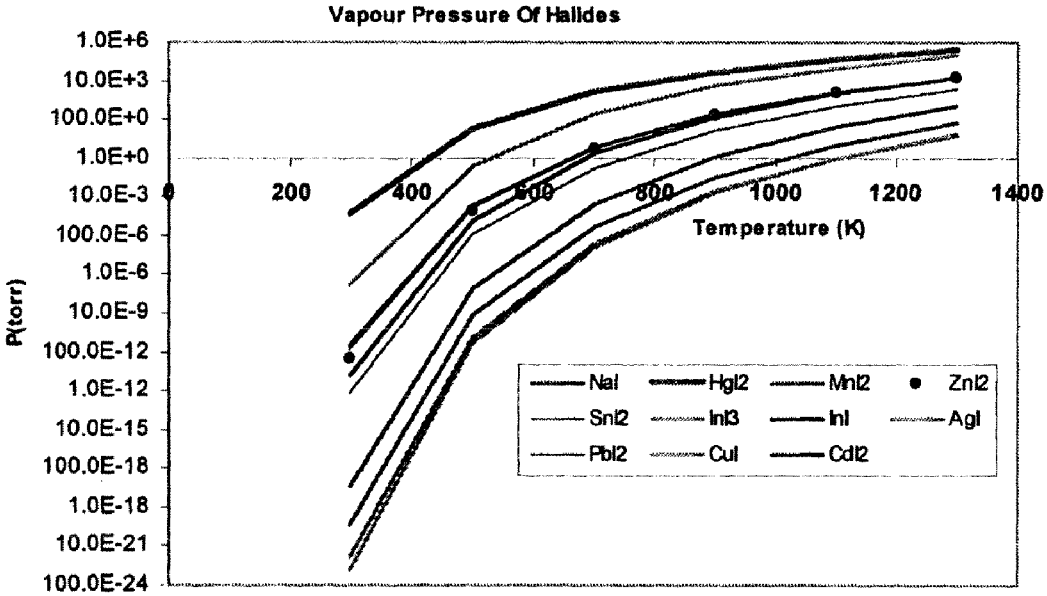
FIG. 3 graphically compares the vapor pressure of various potential getter iodides, including iodides dosed in ceramic metal halide lamps, at a temperature of 1000K.

Another important aspect in choosing a metallic halide getter in accordance with the present invention is the vapor pressure of the metallic getter with respect to the vapor pressure of mercury iodide. Getter materials that satisfy this criterion will remove excess iodine formed in the arc-tube from the discharge environment. Metallic iodide getters that meet this requirement are shown in FIG. 3, and include sodium, tin, lead, indium, copper, manganese, cadmium, zinc and silver.

Figure 4:
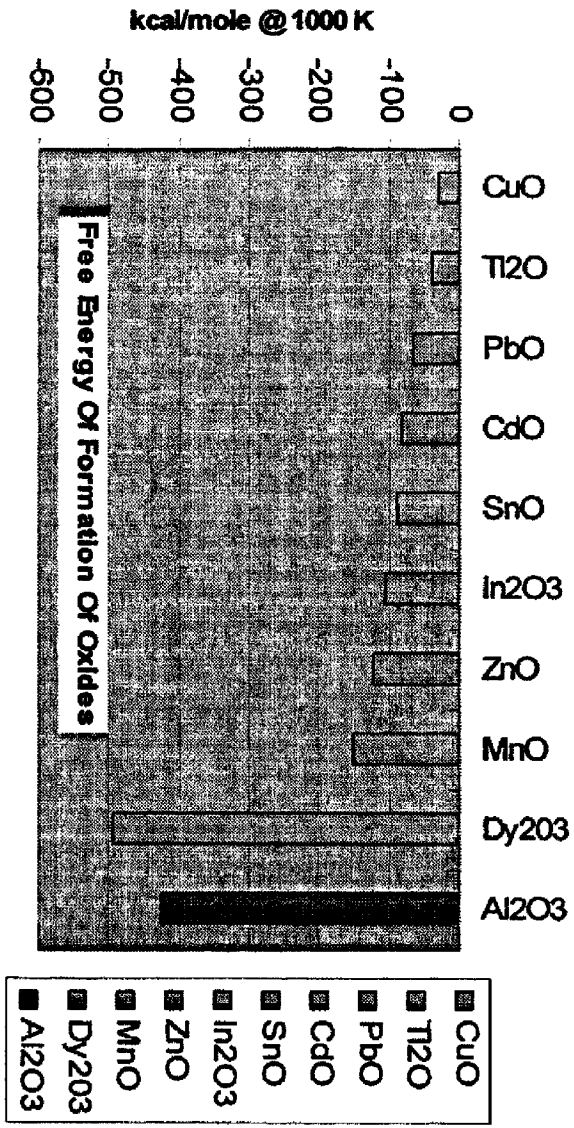
FIG. 4 graphically compares the free energy of the formation of oxides for potential getters.

A final desirable attribute for the metallic getter is the stability of the oxides of the metallic getters relative to aluminum oxide. Preferably, the free energies of formation of the metallic getter oxides be lower than that of aluminum oxide, otherwise the metallic iodide getter material could cause degradation of the main discharge body of the CMH lamp. As can be seen by the graph in FIG. 4, copper, thallium, lead, cadmium, tin, indium, zinc and manganese.

The use of metallic halide getters within the fill of the arc-tube in electroded high watt ceramic metal halide lamps according to the preceding will reduce the formation of mercury iodide, and therefore tungsten transport should be inhibited. This will achieve better lumen maintenance.

Zinc, manganese, indium, cadmium and lead, which satisfy each criteria may be particularly good selections as a getter material. Furthermore, it is noted that the present invention may be particularly beneficial in conjunction with high wattage CMH lamps. For example, lamps operating at above about 150 watts.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. An electroded ceramic metal halide lamp assembly comprising:

a light transmissive arc-tube surrounding at least one electrode;

a fill disposed in said arc-tube, said fill including at least one metal halide; and a metallic halide getter, wherein said metallic halide getter has a Gibbs free energy value of between about higher than mercury iodide and lower than thallium iodide.

2. The lamp assembly of claim 1 wherein said arc-tube is a ceramic material, said ceramic material being a monocrystalline metal oxide, polycrystalline metal oxide or a polycrystalline non-oxide material.

3. The lamp assembly of claim 1 wherein said metallic halide getter includes a metallic component, said metallic component comprised of zinc, manganese, cadmium, lead or silver.

4. The lamp assembly of claim 1 wherein said fill includes halides of sodium, potassium, cesium, thallium, mercury, indium, magnesium, calcium, lanthanide series, and mixtures thereof.

5. The lamp assembly of claim 1 wherein said metallic halide getter has a vapor pressure less than the vapor pressure of mercury halide.

6. The lamp assembly of claim 1 wherein said metallic halide getter has a free energy of oxide formation less than the free energy of formation of $Al_2O_3$.

7. The lamp assembly of claim 1 wherein said metallic halide getter includes at least one of bromine and iodine.

8. An electroded ceramic metal halide lamp assembly comprising:

a light transmissive arc-tube surrounding at least one electrode;

a fill disposed in said arc-tube, said fill including at least one metal halide; and a metallic halide getter, wherein said metallic halide getter has a vapor pressure less than vapor pressure of mercury iodide.

9. The lamp assembly of claim 8 wherein said arc-tube is a ceramic material, said ceramic material being a monocrystalline metal oxide, polycrystalline metal oxide or a polycrystalline non-oxide material.

10. The lamp assembly of claim 8 wherein said metallic halide getter includes a metallic component, said metallic component being zinc, manganese, cadmium, lead or silver.

11. The lamp assembly of claim 8 wherein said fill includes halides of sodium, potassium, cesium, thallium, mercury, indium, magnesium, calcium, lanthanide series, and mixtures thereof.

12. The lamp assembly of claim 8 wherein said metallic iodide component has a Gibbs free energy value of about between higher than mercury iodide and less than thallium iodide.

13. The lamp assembly of claim 8 wherein said metallic iodide component has a free energy of oxide formation less than the free energy of formation of $Al_2O_3$.

14. The lamp assembly of claim 8 wherein said metallic halide getter includes a halide component, said halide component being iodine or bromine.

15. An electroded ceramic metal halide lamp comprising:

a light transmissive arc-tube;

a fill disposed in said arc-tube, said fill including at least one metal halide; and a metallic halide getter wherein said metallic halide getter has a free energy of oxide formation less than the free energy of formation of $Al_2O_3$.

16. The lamp assembly of claim 15 wherein said arc-tube is a ceramic material, said ceramic material being a monocrystalline metal oxide, polycrystalline metal oxide or a polycrystalline non-oxide material.

17. The lamp assembly of claim 15 wherein said metallic halide getter includes a metallic component, said metallic component being zinc, manganese, cadmium, lead or silver.

18. The lamp assembly of claim 15 wherein said fill includes halides of sodium, potassium, cesium, thallium, mercury, indium, magnesium, calcium, lanthanide series, and mixtures thereof.

19. The lamp assembly of claim 15 wherein said metallic halide getter has a vapor pressure less than vapor pressure of mercury iodide.

20. The lamp assembly of claim 15 wherein said metallic halide getter has a Gibbs free energy value of about between higher than mercury iodide and less than thallium iodide.

21. The lamp assembly of claim 15 wherein said metallic halide getter includes a halide component, said halide component being iodine and bromine.

* * * * *